US008420918B2

(12) United States Patent
Yoshimura et al.

(10) Patent No.: US 8,420,918 B2
(45) Date of Patent: Apr. 16, 2013

(54) PEDAL DEVICE, AND ELECTRONIC MUSICAL INSTRUMENT INCLUDING THE PEDAL DEVICE

(75) Inventors: Michiko Yoshimura, Hamamatsu (JP); Kenichi Nishida, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 13/336,246

(22) Filed: Dec. 23, 2011

(65) Prior Publication Data

US 2012/0174739 A1 Jul. 12, 2012

(30) Foreign Application Priority Data

Jan. 6, 2011 (JP) ..... 2011-001562

(51) Int. Cl.
*G10C 3/26* (2006.01)

(52) U.S. Cl.
USPC ..... 84/225

(58) Field of Classification Search ..... 84/225.229, 84/746, 615, 426
See application file for complete search history.

(56) References Cited

U.S. PATENT DOCUMENTS 5,107,748 A * 4/1992 Muramatsu et al. ..... 84/658

FOREIGN PATENT DOCUMENTS

JP 2004334008 A 11/2004

* cited by examiner

*Primary Examiner* — Kimberly Lockett
(74) *Attorney, Agent, or Firm* — Rossi, Kimms & McDowell LLP

(57) ABSTRACT

Pedal device for an electronic keyboard instrument includes a pedal having opposed side walls extending downward from the opposite side edges, in a width direction, of an upper wall, and a reactive force imparting member which imparts reactive force to the pedal by being pressed by the lower surface of the pedal. The reactive force imparting member includes a plate-shaped base portion mounted on a mounting portion of a support member, and an upwardly-convexed dome-shaped body portion integrally formed with the upper surface of the base portion. The body portion and mounting portion each have a width dimension smaller than a distance between the opposed side walls of the pedal so that, during stroke action of the pedal, the body portion and mounting portion falls within a space between the opposed side walls.

7 Claims, 6 Drawing Sheets

PEDAL DEVICE, AND ELECTRONIC MUSICAL INSTRUMENT INCLUDING THE PEDAL DEVICE

BACKGROUND

The present invention relates to an improved pedal device suited for use in electronic musical instruments, such as electronic keyboard instruments, and an electronic musical instrument including such an improved pedal device.

In acoustic pianos that are among natural keyboard instruments, and particularly in grand pianos, as a human player steps on or depresses a damper pedal through a great stroke length, depressing force is transmitted to dampers via connection portions so that the dampers, so far held in contact with strings, start to be lifted upward away from the strings. At that time, a variation rate of reactive force increases due to, among other things, increase in frictional force caused by a resilient element of the entire connection portion and non-uniformity of movement between adjoining dampers. Thus, the human player feels that the variation rate of reactive force received from the damper pedal is changing in accordance with a depressed depth (stroke) of the damper pedal.

Hence, there has been known a technique which, in a pedal device of an electronic keyboard instrument, changes the variation rate of reactive force, received from the damper pedal, in accordance with a stroke length of the damper pedal, as disclosed in Japanese Patent Application Laid-open Publication No. 2004-334008 (hereinafter referred to as "the relevant patent literature"). The known technique disclosed in the relevant patent literature is arranged to cause two spring members to act progressively on the damper pedal. With this technique, it is possible to obtain a characteristic that the reactive force starts increasing midway through the entire stroke length in response to depressing operation of the pedal.

Another example of the construction for progressively changing the reactive force to the pedal of the electronic keyboard instrument is known, which includes, in place of the aforementioned springs, a reactive force imparting member for imparting reactive force to the pedal by being pressed by the pedal depressed by a human player. Such a reactive force imparting member is, for example, in the form of a one-piece member integrally formed of rubber or resilient synthetic resin material and having a generally upwardly-convexed hollow dome shape, and it is disposed in such a manner as to start being pressed by the pedal at a position midway through the pedal stroke. The reactive force imparting member includes a flat plate-shaped base portion, a generally cylindrical body portion formed on the upper surface of the base portion, and an abutting portion provided centrally on an upper end portion of the body portion. The abutting portion descends by being abutted against and pressed downward by the lower end surface of the pedal being depressed, so that the body portion resiliently deforms to produce reactive force to the depressing force applied to the pedal.

Examples of the aforementioned pedal that presses the dome-shaped reactive force imparting member include one having a downwardly-opening, inverted-U sectional shape defined by an upper wall and opposed side walls extending downward from the opposite side edges of the upper wall. In mounting the dome-shaped reactive force imparting member under the lower surface of the pedal, it is necessary to appropriately set a mounted position of the reactive force imparting member relative to an initial (undepressed) position of the pedal with a stroke length of the pedal taken into consideration. Therefore, a gap that is greater than the pedal stroke length when the pedal is in the initial position is provided between the lower ends of the opposed side walls and the reactive force imparting member. However, because the gap is greater in size than a width of a finger of a person, a finger or the like might be caught between the lower end of the pedal and the reactive force imparting member when the pedal is depressed from the initial position. Thus, there has been a need for further measures to secure sufficient safety of the pedal device.

Further, to secure the stroke length of the pedal, the dome-shaped reactive force imparting member has to be mounted spaced downwardly from the initial position of the pedal. Thus, as viewed from above the pedal, the reactive force imparting member is not completely hidden under the pedal so that a part of the reactive force imparting member may be undesirably seen from the human player. Thus, the human player may be given an uncomfortable feeling due to a difference from the pedal device of the acoustic piano.

Furthermore, in the case where the reactive force imparting member is mounted spaced downwardly from the initial position of the pedal as noted above, the lower surface of the pedal and the abutting portion of the reactive force imparting member would be greatly spaced from each other. In such a case, the abutting portion of the reactive force imparting member cannot be pressed directly by the lower surface of the pedal, and thus, a separate member (i.e., actuator) for pressing a key top portion has to be provided on or adjacent to the lower surface of the pedal. As a consequence, there arises the problem that the number of component parts for constituting the pedal device increases.

SUMMARY OF THE INVENTION

In view of the foregoing prior art problems, it is an object of the present invention to provide an improved pedal device which not only can have a reduced gap between the pedal in the initial position and the reactive force imparting member but also can have improved safety and design with a simple construction having a reduced number of necessary component parts, as well as an electronic musical instrument including such a pedal device.

In order to accomplish the above-mentioned object, the present invention provides an improved pedal device (1), which comprises: a pedal (10) having an upper wall (10*a*), opposed side walls (10*b*) extending downward from the opposite side edges of the upper wall that extend in a longitudinal direction of the upper wall, and a space (10*f*) defined under the lower surface (10*c*) of the upper wall between the opposed side walls (10*b*); a support portion (14) which supports the pedal (10) in such a manner that the pedal (10) is capable of stroke action in a vertical or up-down direction; a reactive force imparting member (50) which imparts reactive force to the stroke action of the pedal (10) by being pressed by another member provided on or adjacent to the lower surface (10*c*) of the upper wall (10*a*) of the pedal (10); and a support member (70) including a flat plate-shaped mounting portion (77) for mounting thereon the reactive force imparting member (50). The reactive force imparting member (50) includes a plate-shaped base portion (52) mounted on the mounting portion (77) of the support member (70), an upwardly-convexed dome-shaped body portion (51) integrally formed on the upper surface (52*a*) of the base portion (52), and an abutting portion (59) provided on the upper end of the body portion (51) for abutment there against of the pedal (10), and the body portion (51) of the reactive force imparting member (50) has a width dimension smaller than an interval or distance between the opposed side walls (10*b*) of the pedal (10) so that, during the stroke action of the pedal (10), the body portion (51) falls within the space (10*f*) between the opposed side walls (10*b*). Note that the term "upper" is used herein to refer to one of upper and lower directions of the pedal device while the term "lower" is used herein to refer to the other of the upper and lower directions of the pedal device (1), and particularly that the terms "upper" and "lower" define directions with no relation to "upper" and "lower" of the pedal device (1) in its actual installed state or orientation. Therefore, depending on the actual installed state or orientation of the pedal device (1), the terms "upper surface", "above", etc. are sometimes used herein in connection with a direction other than the upper or upward direction, such as a sideways or lateral direction.

Generally, in a pedal device, which includes: a pedal having opposed side walls extending downward from the opposite side edges of an upper wall that extend in a longitudinal or length direction of the upper wall; and a reactive force imparting member provided under the lower surface of the pedal, if a width direction of the reactive force imparting member is set greater than an interval or distance between the opposed side walls, the opposed side walls would abut against or approach extremely close to the reactive force imparting member as the pedal has descended in its stroke action. Therefore, a gap between the pedal in the initial, undepressed position and the reactive force imparting member has to be set equal to or greater than a stroke length of the pedal. By contrast, in the pedal device of the present invention, which is constructed in such a manner that, during the stroke action of the pedal, the body portion of the reactive force imparting member falls within the space between the opposed side walls, the gap between the opposed side walls of the pedal in the initial position and the reactive force imparting member can be set smaller than the stroke length of the pedal. Therefore, the gap between the pedal and the reactive force imparting member can be made small enough to effectively prevent a finger of a person or the like from accidentally entering the gap, and thus, it is possible to reduce a likelihood of a finger of a person or the like being accidentally caught in the gap, to thereby significantly improve the safety of the pedal device.

Furthermore, in the pedal device of the present invention, which is constructed in such a manner that not only the gap between the pedal and the reactive force imparting member is significantly reduced as compared to that in the conventionally-known counterparts but also the base portion of the reactive force imparting member falls between the opposed side walls of the pedal, the reactive force imparting member can be hidden under the lower surface of the pedal as viewed from above the pedal. Thus, the present invention can prevent the human player from being given an uncomfortable feeling due to a difference between the pedal device of the invention, provided with the reactive force imparting member, from the pedal device of the acoustic piano. In addition, the pedal device of the present invention can have an improved design.

Furthermore, in the pedal device of the present invention, where the reactive force imparting member can be disposed close to the pedal, the abutting portion of the reactive force imparting member can be pressed directly by the lower surface of the upper wall of the pedal, and thus, any separate component part for pressing the reactive force imparting member need not be provided. As a result, it is possible to reduce the total number of necessary component parts to thereby simplify the construction of the pedal device and reduce the size and weight of the pedal device.

Preferably, in the pedal device of the present invention, the base portion (52) of the reactive force imparting member (50) has straight opposite side edges (52*d*) extending along the opposed side walls (10*b*) of the pedal (10), and the body portion (51) of the reactive force imparting member (50) is of a dome shape having a circular lower end part formed on the upper surface (52*a*) of the base portion (52) between the opposite side edges (52*d*) of the base portion (52). Further, projecting engagement portions (52*b*) for fixing the base portion (52) to the mounting portion (77) of the support member (70) are formed on the lower surface (52*c*) of the base portion (52) near the opposite side edges (52*d*) of the base portion (52), and the outer side end, in a width direction of the pedal, of each of the projecting engagement portions (52*b*) is located either at a same position as or inside (inwardly of) the outer side end of a lower end part of the body portion (51). Because the outer side end, in the width direction of the pedal, of each of the projecting engagement portions is located either at a same position as or inside (i.e., inwardly of) the outer side end of the lower end part of the body portion as noted above, a widthwise dimension of the base portion can be reduced to the same as, or to near, that of the lower end part of the body portion. Thus, it is possible to reduce the overall size of the reactive force imparting member, including the base portion, while maximizing the size of the body portion. As a result, the pedal device of the present invention can be reduced in size and weight. Further, because it is possible to reduce the total amount of the material forming the reactive force imparting member, the necessary cost of the pedal device can be significantly reduced.

Further, preferably, in the pedal device of the present invention, the lower end part of the body portion (51) of the reactive force imparting member (50) has a width dimension (D3) substantially equal to a width dimension (D1) of the base portion (52). With this arrangement, the entire reactive force imparting member, including the body portion and the base portion, can be accommodated in a deeper position within the space between the side walls of the pedal. As a result, the pedal device of the present invention can be even further reduced in size and weight. In addition, the reactive force imparting member can be made less visible as viewed from above the pedal.

Furthermore, preferably, in the pedal device of the present invention, the support member (70) includes a leg portion (75) connected to the lower surface (77*c*) of the mounting portion (77), and engaging portions (77*b*) in the form of through-holes formed in the mounting portion (77) for engaging the engagement portions (52*b*) formed on the base portion (52). The leg portion (75) is connected to the lower surface (77*c*) of the mounting portion (77) inside the opposite side edges (77*d*), in the width direction, of the lower surface (77*c*) of the mounting portion (77), and the engaging portions (77*b*) are disposed between the opposite side edges (77*d*), in the width direction, of the mounting portion (77) and the leg portion (75). Thus, even in the case where the leg portion is provided on the lower surface of the mounting portion of the support portion, the leg portion and the engagement projections can be provided without interfering with each other.

According to another aspect of the present invention, there is provided an improved pedal device (1-2), which comprises: a pedal (10) having an upper wall (10*a*), opposed side walls (10*b*) extending downward from the opposite side edges of the upper wall (10*a*) that extend in a longitudinal direction of the upper wall (10*a*), and a space (10*f*) defined under the lower surface (10*c*) of the upper wall (10*a*) between the opposed side walls (10*b*); a support portion (14) which supports the pedal (10) in such a manner that the pedal (10) is capable of stroke action in a vertical or up-down direction; a reactive force imparting member (50) provided in the space (10*f*) under the lower surface (10*c*) of the pedal (10) for imparting reactive force to the stroke action of the pedal (10);

and a support member (70-2) including a pressing portion (77-2) for pressing the reactive force imparting member (50). The reactive force imparting member (50) includes a plate-shaped base portion (52) mounted, directly or via another member, on the lower surface (10*c*) of the upper wall (10*a*), a downwardly-convexed dome-shaped body portion (51) integrally formed on the lower surface (52*a*) of the base portion (52), and an abutting portion (59) provided on the lower end of the body portion (51) for abutment against the pressing portion (77-2). Further, the pressing portion (77-2) of the support member (70) has a width dimension smaller than a distance between the opposed side walls (10*b*) of the pedal (10) so that, during the stroke action of the pedal (10), the pressing portion (77-2) falls within the space (10*f*) between the opposed side walls (10*b*).

According to still another aspect of the present invention, there is provided an electronic musical instrument including any one of the aforementioned pedal devices of the invention. By the provision of such a pedal device, the electronic musical instrument can have improved safety and design and reduced size and weight.

Note that numerical values and characters in parentheses above represent reference numerals of corresponding constituent elements in later-described embodiments.

According to the pedal device and the electronic musical instrument of the present invention, it is possible to reduce the gap between the pedal in the initial position and the reactive force imparting member and achieve improved safety and design with a simple construction having a reduced total number of necessary component parts.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

First Embodiment

Figure 1A:
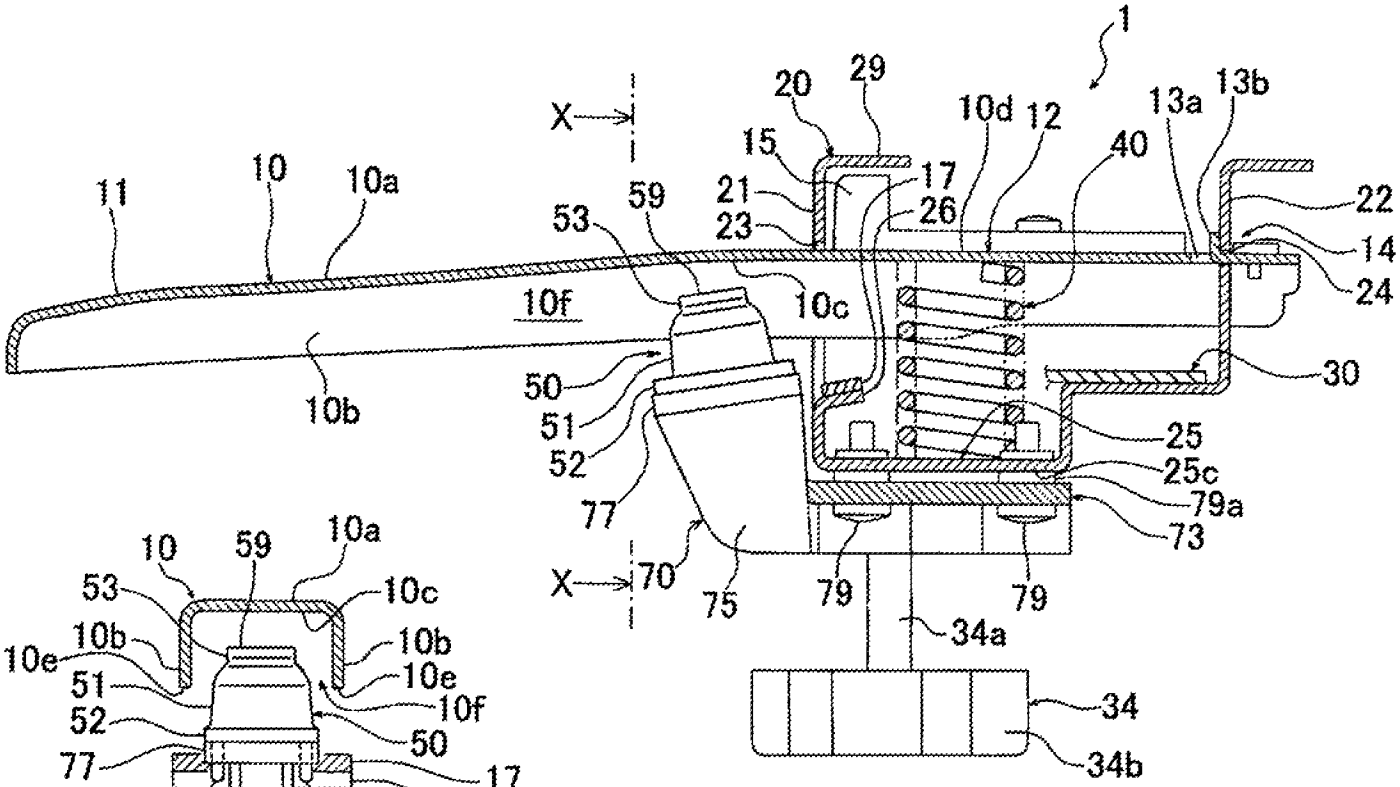
FIG. 1A is a partly-sectional side view showing an example general construction of a first embodiment of a pedal device of the present invention.
Figure 1B:
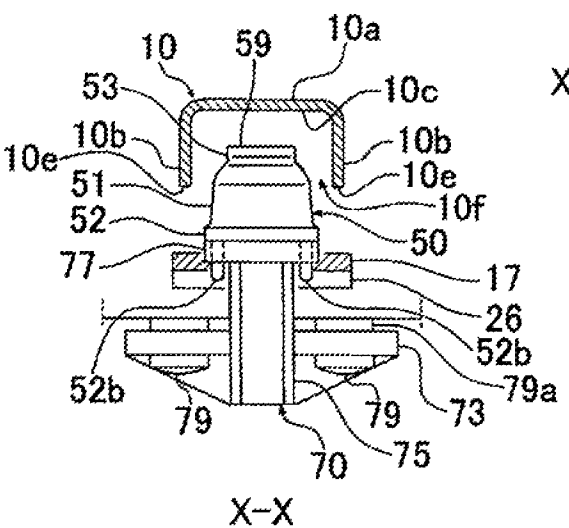
FIG. 1B is a view taken in a direction of arrows X-X of FIG. 1A.

FIG. 1A is a partly-sectional side view showing an example general construction of a first embodiment of a pedal device of the present invention, FIG. 1B is a view taken in a direction of arrows X-X of FIG. 1A, i.e. a partly-sectional front view of a pedal 10 and a reactive force imparting member 50. The pedal device 1 shown in FIGS. 1A and 1B is mounted on an electronic keyboard instrument, such as an electronic piano, for being operated or depressed by a human player, and it includes the pedal 10, a frame 20 pivotably supporting the pedal 10, and a coil spring 40 and dome-shaped reactive force imparting member 50 for imparting reactive force to depression of the pedal 10. Although the pedal device 1 includes three pedals corresponding to a damper pedal, sostenuto pedal and soft pedal of a grand piano, the figures only show the pedal 10 located rightmost as viewed from a human player and corresponding to the damper pedal of the grand piano with illustration of the other pedals omitted. Because the embodiment of the pedal device 1 includes the pedal 10 corresponding to the damper pedal, the following mainly describe constructions and behavior of the pedal 10 and other component parts around the pedal 10. Further, in the following description, one side, in a length or longitudinal direction, of the pedal 10 which is located closer to the human player playing the electronic keyboard instrument and which is depressed by a foot of the human player will be referred to as "front" or "front side", while the other side, in the longitudinal direction, of the pedal 10 will be referred to as "rear" or "rear side". Further, in the following description, the term "width direction" is used to refer to a width direction generally perpendicular to the longitudinal direction of the pedal 10.

The frame 20 is formed in a generally rectangular box shape by bending a plate-shaped member of metal or the like. More specifically, the frame 20 is formed in a horizontally elongated shape to straddle across the individual pedals including the pedal 10. Opening portions 23 and 24 are formed in positions of a front wall 21 and rear wall 22, respectively, to which the pedal 10 is mounted.

The pedal 10 is a member having an elongated generally flat shape, whose front side is provided as an operation portion 11 to be stepped on or depressed by a foot of the human player and whose rear side is provided as a mounting portion 12 for being mounted to the frame 20. As shown in FIG. 1B, the pedal 10 has a downwardly-opening, inverted-U sectional shape defined with an upper wall 10*a* extending in the longitudinal direction and opposed side walls 10*b* extending downward from the opposite side edges of the upper wall 10*a*, and a downwardly opening space 10*f* is defined between the side walls 10*b* under the lower surface 10*c*. Further, a bent portion 13*b* is formed by bending upward an edge portion of the opening portion 13*a*.

The opening portion 23 formed in the front wall 21 of the frame 20 is of a rectangular shape greater than the cross section of the pedal 10. The opening portion 24 formed in the rear wall 22 of the frame 20 has a generally U shape extending along the cross section of the pedal 10. The pedal 10 is inserted into the frame 20 through the opening portion 23 so that the mounting portion 12 is accommodated within the frame 20 and the rear end of the pedal 10 projects rearwardly out of the opening portion 24. Also, the bent portion 13*b* of the pedal 10 abuts against the upper edge of the opening portion 24 of the rear wall 22 in such a manner that the bent portion 13*b* and the opening portion 24 pivotably engage each other. Thus, the pedal 10 is mounted in such a manner that the operation portion 11 is vertically swingable about a pivot point 14 where the bent portion 13*b* and the opening portion 24 engage each other.

The coil spring 40 is disposed under a portion of the pedal 10 within the frame 20. The coil spring 40 is a spring formed by winding a resilient wire rod of metal or the like in a coil shape and produces resilient force (biasing force) by being compressed in an axial direction thereof. The coil spring 40 is placed on a front end portion of a bottom wall 25 within the frame 20. The upper end of the coil spring 40 abuts against the lower surface 10*c* of the pedal 10. In an initial position where human player's depressing operation starts, the pedal 10 rests stationary on the coil spring 40. In the initial position from which pedal depression operation can be started, the pedal 10 is supported at a rear region of the mounting portion 12 by the pivot point 14 and supported at a front region of the mounting portion 12 by the coil spring 40, so that the entire pedal 10 is supported generally horizontally or in a front-rear direction (longitudinal direction). Further, a circuit board 30 is disposed behind or rearwardly of the coil spring 40 disposed within the frame 20. Although not specifically shown, switch contacts etc. for converting movement, along the stroke, of the pedal 10 into electrical output can be provided on the circuit board 30.

Further, an adjuster 34 is mounted to the lower surface 25*c* of the bottom wall 25 of the frame 20. The adjuster 34 includes a shaft portion 34*a*, and a base portion 34*b* fixed to the lower end of the shaft portion 34*a*. Although not specifically shown, the upper end of the shaft portion 34*a* is screwed into a threaded hole formed in the bottom wall 25. The shaft portion 34*a* is mounted to a generally central portion, in a width direction, of the bottom wall 25, and the lower end of the base portion 34*b* abuts against a floor surface (not shown). The adjuster 34 is adjustable in its height position relative to the bottom wall 25 of the frame 20 by the shaft portion 34*a* and base portion 34*b* being rotated, so that the pedal device 1 is adjustable in its height position relative to the floor surface.

An upper limit stopper 15 for defining an upper limit position of the pedal 10 is provided on a portion of the upper surface 10*d* of the pedal 10 within the frame 20. When the pedal 10 is in the initial position (uppermost position), the upper limit stopper 15 is located proximate to the upper wall 29 of the frame 20.

A bent portion 26 bent rearwardly to the interior of the frame 20 is formed on the lower end edge of the opening portion 23 formed in the front wall 21 of the frame 20, and a lower limit stopper 17 for defining a lower limit position of the pedal 10 is provided on the upper surface of the bent portion 26. The lower limit stopper 17 is formed of a shock-absorbing material for absorbing an impact caused by the pedal 10 abutting against the lower limit stopper 17. The lower limit stopper 17 is opposed to and spaced by a predetermined distance from the lower ends of the side walls 10*b* of the pedal 10 in the initial position. Further, as shown in FIG. 1A, the bent portion 26 and the lower limit stopper 17 slightly slant downward in a rear-to-front direction.

A support member 70 for supporting the dome-shaped reactive force imparting member 50 is provided forwardly and downwardly of the frame 20. The support member 70, which is a one-piece member integrally formed of synthetic resin, includes: a generally flat plate-shaped mounting portion 73 mounted to the lower surface 25*c* of the bottom wall 25 of the frame 20 via a spacer 79*a* by means of screws 79; a leg portion 75 extending obliquely forward and upward from the front end of the mounting portion 73; and a flat plate-shaped mounting portion 77 formed on the distal end (upper end) of the leg portion 75. The leg portion 75 extends, in front of the front wall 21 of the frame 20, upward from near the lower surface 25*c* of the bottom wall 25, and the mounting portion 77 at the distal end of the leg portion 75 is located at generally the same height position as the lower limit stopper 17 provided at the lower end of the opening portion 23. The mounting portion 77 is a rectangular plate-shaped portion and slightly slants downward in the rear-to-front direction in such a manner that its upper surface lies generally parallel to the bent portion 26 and lower limit stopper 17.

Figure 2:
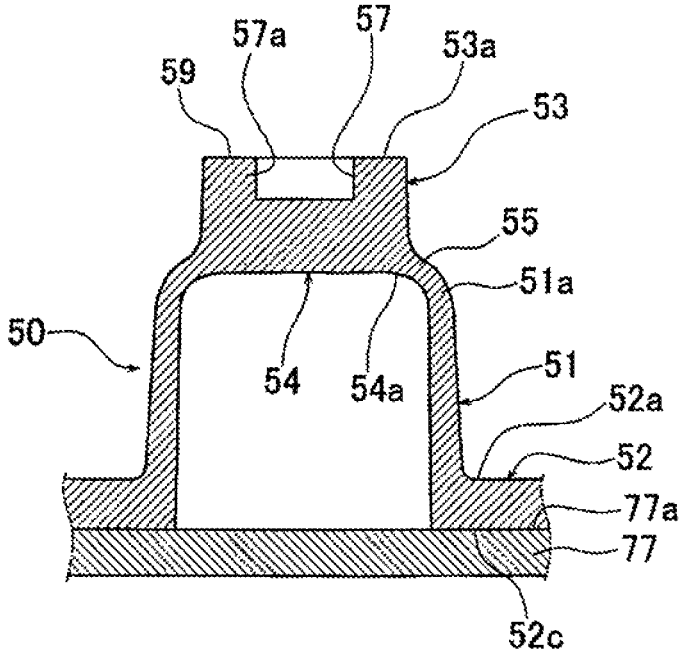
FIG. 2 is a sectional front view showing a detailed construction of a reactive force imparting member provided in the first embodiment.
Figure 3:
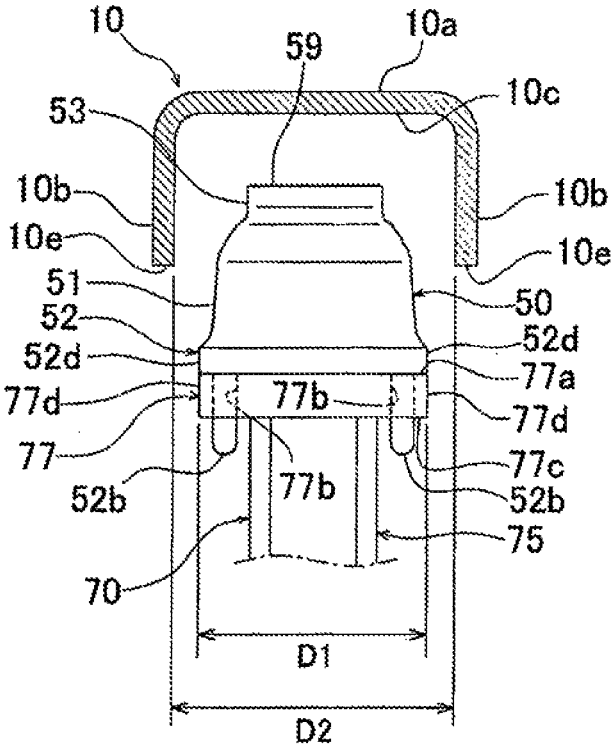
FIG. 3 is an enlarged partly-sectional front view of a pedal, reactive force imparting member and mounting portion provided in the first embodiment.
Figure 4:
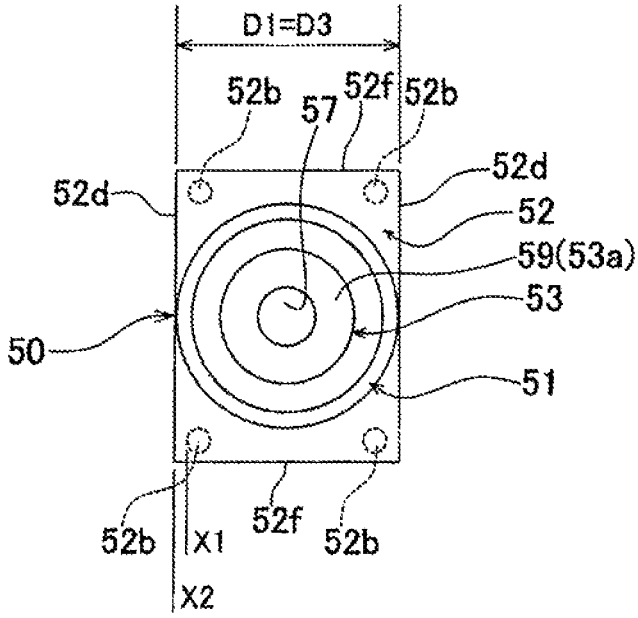
FIG. 4 is a plan view of the reactive force imparting member.

The dome-shaped reactive force imparting member 50 is mounted on the upper surface 77*a* of the mounting portion 77 of the support member 70. FIG. 2 is a sectional side view showing a detailed construction of the reactive force imparting member 50, FIG. 3 is an enlarged partly-sectional front view of the pedal 10, reactive force imparting member 50 and mounting portion 77 as viewed from the front, in the longitudinal direction, of the pedal 10. Further, FIG. 4 is a plan view of the reactive force imparting member 50. The reactive force imparting member 50 is a one-piece member integrally formed of a resilient material and has a generally upwardly-convexed hollow dome shape. More specifically, the reactive force imparting member 50 includes: a flat plate-shaped base portion 52; a generally cylindrical body portion 51 projecting upward from the upper surface 52*a* of the base portion 52; a key top portion 53 projecting upward from the upper end 51*a* of the generally cylindrical body portion 51 and having a smaller diameter than the body portion 51; and a connection portion 55 interconnecting the outer periphery 54*a* of the lower surface 54 and the upper end 51*a* of the body portion 51.

As shown in FIG. 4, the base portion 52 is formed in a rectangular shape having long sides 52*d* extending in the longitudinal direction of the pedal 10 and short sides 52*f* extending in the width direction of the pedal 10. The long sides 52*d* extend straight along the side walls 10*b* of the pedal 10. Small projections (engagement portions) 52*b*, projecting toward the lower surface 52*c*, are formed on the base portion 52 near four corners of the base portion 52. Further, the mounting portion 77 of the support member 70 is formed in a rectangular shape extending along the outline of the of the base portion 52 of the reactive force imparting member 50, and through-holes (engaging portions) 77*b* for engagement with the small projections (engagement portions) 52*b* are formed in the mounting portion 77 near four corners of the mounting portion 77 in positionally corresponding relation to the small projections 52*b*.

The key top portion 53 is a generally circular columnar portion formed concentrically with the body portion 51 and having a smaller diameter than the body portion 51. A generally circular opening portion 57 surrounded by an outer circumferential wall 57*a* is formed centrally in the upper surface 53*a* of the key top portion 53. The upper end of the outer circumferential wall 57*a* is formed as an abutting portion 59 abutting against the lower surface 10*c* of the pedal 10. The opening portion 57 is a circular, bottomed hollow recessed halfway down the height of the key top portion 53.

The reactive force imparting member 50 is provided on the upper surface 77*a* of the mounting portion 77 by the small projections 52*b* of the base portion 52 being engaged in the through-holes 77*b* of the mounting portion 77. As shown in FIG. 1A, the reactive force imparting member 50 is mounted at the base portion 52 on the mounting portion 77 of the support member 70 with the abutting portion 59 of the key top portion 53 facing the lower surface 10*c* of the pedal 10.

The following describe relationship in size and shape between the pedal 10 and the reactive force imparting member 50. As shown in FIG. 3, the mounting portion 77 of the support member 70 has a same width dimension as the base portion 52. Further, as shown in FIG. 4, the small projections 52*b* of the reactive force imparting member 50 are formed near the long sides (opposite side edges spaced from each other in the width direction) 52*d* (more specifically, immediately inside or inwardly of the long sides 52*d*). Further, a lower end part of the body portion 51 of the reactive force imparting member 50 has a width dimension D3 that is equal to the width dimension D1 of the base portion 52 (i.e., D3=D1). Further, an outer side end X1, in the width direction, of each of the small projections 52*b* is located inwardly of an outer side end X2 of the lower end part of the body portion 51. Note, however, that the width dimension D3 of the lower end of the body portion 51 need not necessarily be equal to the width dimension D1 of the base portion 52; for example, the width dimension D3 of the lower end part of the body portion 51 may be slightly smaller than the width dimension D1 of the base portion 52.

The width dimensions of a lower end part of the base portion 52 of the reactive force imparting member 50 and the mounting portion 77 of the support member 70 are each set smaller than a distance D2 between the opposed side walls 10*b* (more specifically, between the inner surfaces of the opposed side walls 10*b*) of the pedal 10 (D1≦D2). Thus, during stroke action of the pedal 10, the entire reactive force imparting member 50, including the body portion 51 and base portion 52, and the mounting portion 77 of the support member 70 fall within the opening space 10*f* between the opposed side walls 10*b* of the pedal 10.

Further, as shown in FIG. 3, the leg portion 75 is connected to a portion, inside the opposite side edges 77*d* in the width direction, of the lower surface 77*c* of the mounting portion 77, more specifically, to a central portion, in the width direction, of the lower surface 77*c*. Further, through-holes 77*b* formed in the mounting portion 77 are located between the side edges 77*d*, in the width direction, of the lower surface 77*c* and the leg portion 75.

Figure 5:
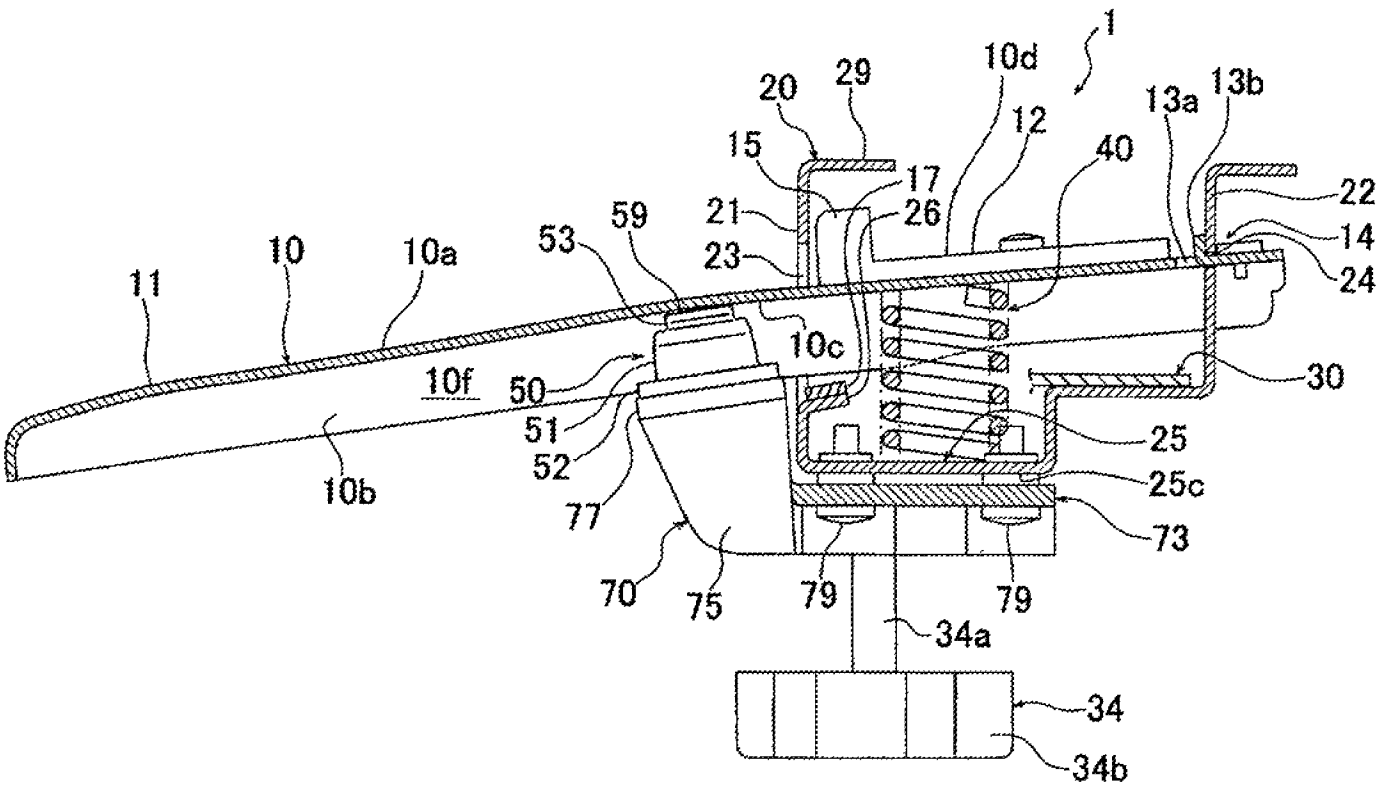
FIG. 5 is a view explanatory of behavior of the pedal device.

The following describe behavior of the pedal device 1 and reactive force imparting member 50 constructed in the aforementioned manner. FIG. 5 is a view explanatory of the behavior of the pedal device 1, which particularly shows a state when the pedal 10 have been depressed. As the human player depresses the pedal 10 in the initial position shown in FIG. 1A, the pedal 10 pivots about the pivot point 14 while compressing the coil spring 40 so that the operation portion 11 descends. During that time, reactive force by the biasing force of the coil spring 40 (hereinafter referred to as "first reactive force") is imparted to the pedal 10. As the pedal 10 further descends, the lower surface 10*c* of the pedal 10 abuts against the abutting portion 59 of the reactive force imparting member 50. Then, as the pedal 10 is further depressed, the reactive force imparting member 50 compressively deforms, so that the pedal 10 descends even further. At that time, a combination of the first reactive force by the coil sprint 40 and a reactive force by the reactive force imparting member 50 (hereinafter referred to as "second reactive force") is imparted to the pedal 10. Then, as the pedal 10 is depressed even further, the lower ends 10*e* of the opposed side walls 10*b* of the pedal 10 abut against the lower limit stopper 17 so that the pedal 10 stops at the lower limit position.

On the other hand, as the human player reduces the force depressing the pedal 10 in the lower limit position, the pedal 10 ascends, initially by the first and second reactive force imparted by the coil sprint 40 and reactive force imparting member 50. As the pedal 10 further ascends, the pedal 10 moves away from the reactive force imparting member 50 and then ascends even further by the first reactive force imparted by the coil spring 40.

The coil spring 40 is constantly in abutting contact with the pedal 10 (even when the pedal 10 is in the initial position (undepression position)). Thus, the coil spring 40 can constantly produce the first reactive force to the pedal 10 (even when the pedal 10 is in the initial position). The reactive force imparting member 50, on the other hand, is constructed to abut against the pedal 10 and hence produce the second reactive force when the pedal 10 has been depressed a predetermined length from the initial position. Thus, if the pedal 10 is constructed to abut against the reactive force imparting member 50 at a particular position corresponding to an uplift start position of dampers of the acoustic piano, the reactive force to be imparted in response to depression of the pedal 10 can be varied in a progressive fashion at the particular position, and thus, it is possible to appropriately reproduce an operation feeling of the damper pedal of the acoustic piano involving an uplift of the dampers.

Figure 6A:
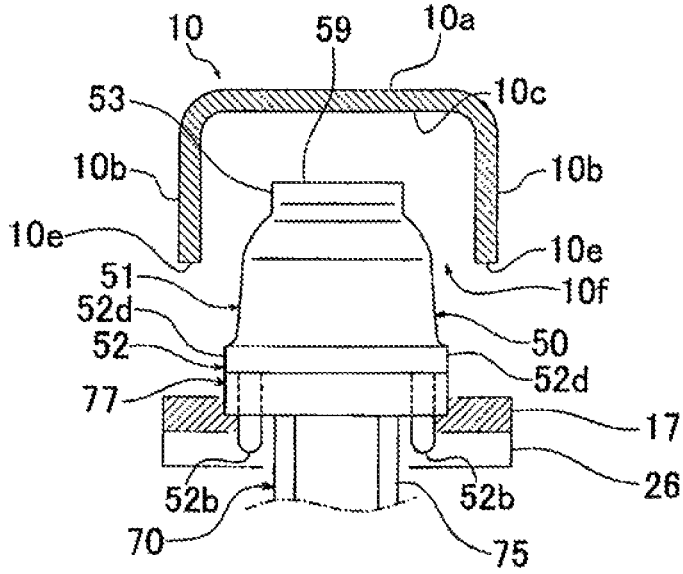
FIGS. 6A to 6C are explanatory of positional relationship between the pedal and the reactive force imparting member during stroke action of the pedal.
Figure 6B:
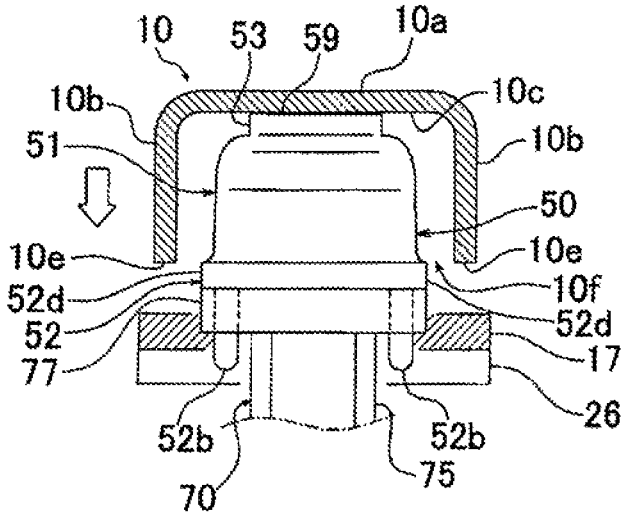
Figure 6C:
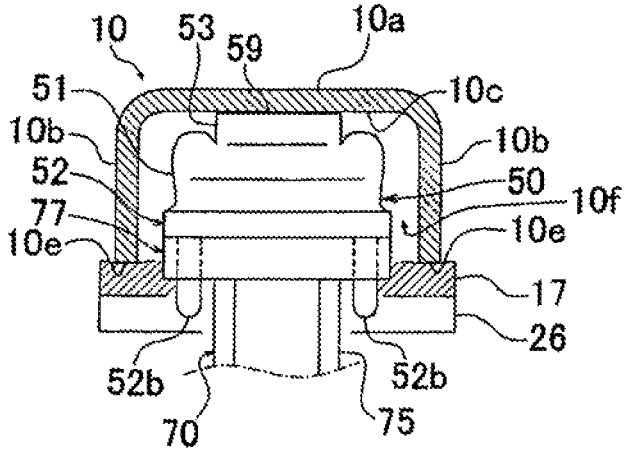

The following describe positional relationship between the pedal 10 and the reactive force imparting member 50 during stroke action of the pedal 10. FIGS. 6A to 6C are explanatory of such positional relationship, each of which is a partly-sectional front view taken from the front of the pedal 10 and the reactive force imparting member 50 and also shows the lower limit stopper 17. More specifically, FIG. 6A shows a state when the pedal 10 is in the initial position, FIG. 6B shows a state when the pedal 10 has been depressed halfway through the stroke, and FIG. 6C shows a state when the pedal 10 has been depressed to the lower limit position.

When the pedal 10 is in the initial position where it is not yet stepped on or depressed by the human player, the pedal 10 is located immediately above the reactive force imparting member 50 as seen in FIG. 6A. Namely, in the initial position, the lower surface 10*c* of the pedal 10 is spaced upwardly from the abutting portion 59 of the reactive force imparting member 50 (i.e., upper surface 53*a* of the key top portion 53), and the lower ends 10*e* of the opposed side walls 10*b* of the pedal 10 are located at the same height as an upper end part of the body portion 51 of the reactive force imparting member 50. Thus, the key top portion 53 and a part of the body portion 51 are located within the downwardly opening space 10*f*. As the pedal 10 is depressed to descend from the initial position, the key top portion 53 and the entire body portion 51 of the reactive force imparting member 50 come to be located within the space 10*f* under the lower surface 10*c* of the pedal 10. In this state, the lower surface 10*c* of the pedal 10 abuts against the abutting portion 59 of the reactive force imparting member 50, so that the key top portion 53 is compressed downward by being pressed by the pedal 10. In this manner, the reactive force imparting member 50 deforms resiliently so that reactive force to the depressing force is applied to the pedal 10.

As the pedal 10 is further depressed to descend from the aforementioned position, the lower ends 10*e* of the opposed side walls 10*b* descend to a position lower than the base portion 52 of the reactive force imparting member 50. After that, the lower ends 10*e* of the opposed side walls 10*b* abut against the lower limit stopper 17, and thus, the pedal 10 stops descending. In this state, the entire reactive force imparting member 50, including the body portion 51 and base portion 52, and the mounting portion 77 of the support member 70 are located within the space 10*f* under the lower surface 10*c* of the pedal 10, as seen in FIG. 6C.

According to the instant embodiment of the pedal device 1, as described above, the dome-shaped body portion 51 of the reactive force imparting member 50 comes to be located within the space 10*f* between the opposed side walls 10*b* during the downward stroke action of the pedal 10. Further, because the width dimension D3 of the lower end of the body portion 51 and the width dimension D1 of the base portion 52 in the reactive force imparting member 50 are set equal to each other, not only the body portion 51 but also the base portion 52 comes to be located within the space 10*f* between the opposed side walls 10*b*. In this way, the gap between the pedal 10 in the initial position and the reactive force imparting member 50 can be set smaller than the stroke length of the pedal 10. Therefore, the gap between the pedal 10 and the reactive force imparting member 50 can be made small enough to effectively prevent a finger of a person or the like from accidentally entering the gap, and thus, it is possible to reduce a likelihood of a finger of a person (particularly, human player) or the like being accidentally caught in the gap, to thereby significantly improve the safety of the pedal device 1. Particularly, because the width dimensions of the base portion 52 in the reactive force imparting member 50 and the mounting portion 77 of the support member 70 are each set smaller than the distance between the side walls 10*b*, the reactive force imparting member 50 can be accommodated in a deeper position within the space 10*f* between the side walls 10*b*. As a result, the instant embodiment of the pedal device 1 can be further reduced in size and weight.

Furthermore, with the instant embodiment of the pedal device 1, which is constructed in such a manner that not only the gap between the pedal 10 and the reactive force imparting member 50 is significantly reduced but also the base portion 52 of the reactive force imparting member 50 and the mounting portion 77 of the support member 70 fall within the space 10*f* between the opposed side walls 10*b* during the pedal stroke action, the reactive force imparting member 50 can be hidden under the lower surface 10*c* of the pedal 10 as viewed from above the pedal 10. Thus, the instant embodiment can prevent the human player from being given an uncomfortable feeling due to a difference the pedal device 1, provided with the reactive force imparting member 50, from the pedal device of the acoustic piano. In addition, the instant embodiment of the pedal device 1 can have an improved design.

Furthermore, with the instant embodiment of the pedal device 1, where the reactive force imparting member 50 can be provided close to the pedal 10 as noted above, the abutting portion 59 of the reactive force imparting member 50 can be pressed directly by the lower surface 10*c* of the pedal 10, and thus, any separate component part for pressing the reactive force imparting member 50 need not be provided on the lower surface 10*c* of the pedal 10. As a result, it is possible to reduce the number of necessary component parts to thereby simplify the construction of the pedal device 1 and reduce the size and weight of the pedal device 1.

Furthermore, because the outer side end X1, in the width direction, of each of the small projections 52*b* is located inwardly of the outer side end X2 of the lower end of the body portion 51, the widthwise dimension of the base portion 52 can be reduced to the same as that of the dome-shaped body portion 51. Thus, it is possible to reduce the overall size of the reactive force imparting member 50 including the base portion 52 while maximizing the size of the body portion 51. As a result, the pedal device 1 can be reduced in size and weight. Further, because it is possible to reduce the amount of the material forming the reactive force imparting member 50, the necessary cost of the pedal device 1 can be significantly reduced.

Furthermore, in the instant embodiment of the pedal device 1, the leg portion 75 of the support member 70 is connected to a central portion, in the width direction, of the lower surface 77*c* of the mounting portion 77, and each of the through-holes 77*b* is located between the opposite side edges 77*d*, in the width direction, of the lower surface 77*c* and the leg portion 75. With such arrangements, the small projections 52*b* of the reactive force imparting member 50 can be fixed at the opposite sides, in the width direction of the mounting portion, of the leg portion 75, and thus, even in the case where the leg portion 75 is provided on the lower surface 77*c* of the mounting portion 77, the leg portion 75 and the small projections 52*b* can be provided without interfering with each other.

Because the mounting portion 77 of the support member 70, which is subjected to a load from the pedal 10 depressed by a foot of the human player, has to have a high mechanical strength, it is conceivable to form the mounting portion 77 in a box shape. However, if vertical ribs constituting side walls of the box shape are provided on or near the side edges of the lower surface 77*c* of the mounting portion 77, there may occur a problem that a sufficient space cannot be secured for forming the through-holes 77*b* to engage the small projections 52*b* of the base portion 52. Therefore, in the support member 70 provided in the instant embodiment of the pedal device 1, the left portion 75 is connected to a central portion, in the width direction, of the lower surface 77*c* of the mounting portion 77 in such a manner that it defines a generally T-shaped angle as the left portion 75 is viewed from the front of the pedal device 1. In this way, a sufficient space for forming the through-holes 77*b* is secured on the lower surface 77*c* of the mounting portion 77 at the opposite sides, in the width direction, of the left portion 75.

Furthermore, in the instant embodiment of the pedal device 1, the support member 70 for supporting the reactive force imparting member 50 includes: the mounting portion 73 fixed to the lower surface 25*c* of the bottom wall 25 of the frame 20; the leg portion 75 extending obliquely forward and upward from the mounting portion 73 along the front wall 21 of the frame 20; and the mounting portion 77 formed on the upper end of the leg portion 75 and located forwardly of the front wall 21. Namely, in the instant embodiment of the pedal device 1, the support member 70 is mounted as a separate component part outside the box-shaped frame 20, and the reactive force imparting member 50 is supported by the support member 70. In this manner, the frame 20 can be reduced in size as compared to the case where the reactive force imparting member 50 is provided inside the frame 20. Further, even in the case where a sufficient space for providing therein the reactive force imparting member 50 cannot be secured within the frame 20, the aforementioned arrangements of the embodiment allow the reactive force imparting member 50 to be provided under the lower surface 10*c* of the pedal 10.

The first embodiment of the pedal device 1 has been described above in relation to the case where the abutting portion 59 of the reactive force imparting member 50 is pressed directly by the lower surface 10*c* of the pedal 10. Alternatively, although not particularly shown, a separate member (i.e., actuator) for pressing the reactive force imparting member 50 may be provided on a portion of the lower surface 10*c* of the pedal 10 between the side walls 10*b* in such a manner that the separate member (i.e., actuator) abuts against the abutting portion 59 of the reactive force imparting member 50.

Second Embodiment

Figures 7A, 7B:
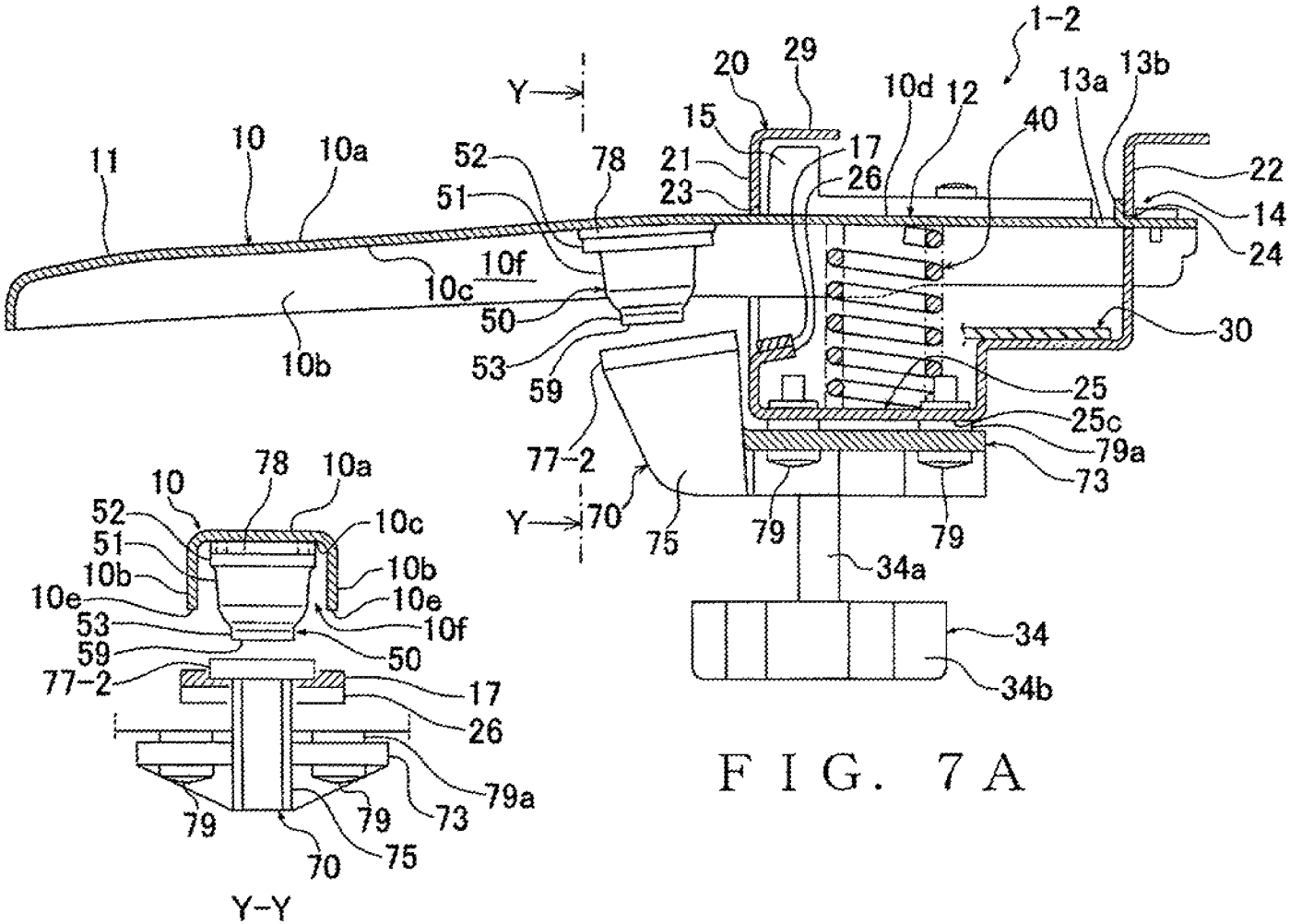
FIG. 7A is a partly-sectional side view showing an example general construction of a second embodiment of the pedal device of the present invention.
FIG. 7B is a view taken in a direction of arrows Y-Y of FIG. 7A.

The following describe a second embodiment of the pedal device 1-2 of the present invention. In the following description about the second embodiment, identical or similar elements to those in the first embodiment are indicated by the same reference numerals as used for the first embodiment and will not be described here to avoid unnecessary duplication. Also note that features other than those explained below in relation to the second embodiment are generally the same as in the first embodiment. FIG. 7A is a partly-sectional side view showing an example general construction of the second embodiment of the pedal device 1-2 of the present invention, and FIG. 7B is a view taken in a direction of arrows Y-Y of FIG. 7A, i.e. a partly-sectional front view of the pedal 10 and reactive force imparting member 50. Whereas the above-described first embodiment is constructed in such a manner that the reactive force imparting member 50 is mounted on the mounting portion 77 of the support member 70 and that the abutting portion 59 of the reactive force imparting member 50 is pressed by the lower surface 10*c* of the pedal 10, the second embodiment is constructed in such a manner that the reactive force imparting member 50 is provided on the lower surface 10C of the pedal 10 so as to be accommodated in the space 10*f* under the lower surface 10*c* between the opposed side walls 10*b* and that the reactive force imparting member 50 is pressed by a pressing portion 77-2 of the support member 70 provided under the pedal 10.

Namely, in the second embodiment of the pedal device 1-2, the reactive force imparting member 50 is vertically inverted in orientation from the reactive force imparting member 50 in the first embodiment, and the base portion 52 of the reactive force imparting member 50 is mounted to the lower surface 10*c* of the pedal 10 via a mounting member 78. Further, the abutting portion 59 at the lower end of the reactive force imparting member 50 is disposed to face the pressing portion 77-2 of the support member 70. Further, similarly to the mounting portion 77 of the support member 70 in the first embodiment, the pressing portion 77-2 of the support member 70 in the second embodiment has a width dimension smaller than the distance between the opposed side walls 10*b* of the pedal 10. Thus, during stroke action of the pedal 10, the pressing portion 77-2 falls within the space 10*f* between the opposed side walls 10*b*.

Namely, in the second embodiment of the pedal device 1-2, the reactive force imparting member 50 is provided on the lower surface 10*c* of the pedal 10 between the opposed side walls 10*b*, and, during stroke action of the pedal 10, the pressing portion 77-2 of the support member 70 falls located between the opposed side walls 10*b*. Thus, the gap between the pedal 10 in the initial position and the pressing portion 77-2 of the support member 70 can be set smaller than the stroke length of the pedal 10. Therefore, the gap can be made small enough to effectively prevent a finger of a person or the like from accidentally entering the gap, and thus, it is possible to reduce a likelihood of a finger of a person or the like being accidentally caught in the gap, to thereby significantly improve the safety of the pedal device 1-2.

Whereas various embodiments of the present invention have been described above, the present invention should not be construed as limited to the described embodiments and may be modified variously within the scope of the technical ideas set forth in the appended claims and the specification and drawings.

This application is based on, and claims priorities to, Japanese patent application No. 2011-001562 filed on 6 Jan. 2011. The disclosure of the priority application, in its entirety, including the drawings, claims, and the specification thereof, are incorporated herein by reference.

What is claimed is:

1. A pedal device comprising:

a pedal having an upper wall, opposed side walls extending downward from opposite side edges of the upper wall that extend in a longitudinal direction of the upper wall, and a space defined under a lower surface of the upper wall between the opposed side walls;

a support portion which supports said pedal in such a manner that said pedal is capable of stroke action in an up-down direction;

a reactive force imparting member which imparts reactive force to the stroke action of said pedal by being pressed by another member provided on or adjacent to the lower surface of the upper wall of said pedal; and a support member including a flat plate-shaped mounting portion for mounting thereon said reactive force imparting member, wherein said reactive force imparting member includes a plate-shaped base portion mounted on the mounting portion of said support member, an upwardly-convexed, dome-shaped body portion integrally formed on an upper surface of the base portion, and an abutting portion provided on an upper end of the body portion for abutment there against of said pedal, and the body portion of said reactive force imparting member has a width dimension smaller than a distance between the opposed side walls of said pedal so that, during the stroke action of said pedal, the body portion falls within the space between the opposed side walls.

2. The pedal device as claimed in claim 1, wherein the base portion of said reactive force imparting member has straight opposite side edges extending along the opposed side walls of said pedal, the body portion of said reactive force imparting member is of a dome shape having a circular lower end part formed on an upper surface of the base portion between the opposite side edges of the base portion, and projecting engagement portions for fixing the base portion to the mounting portion of said support member are formed on a lower surface of the base portion near the opposite side edges of the base portion, an outer side end, in a width direction of the pedal, of each of the projecting engagement portions being located either at a same position as or inside an outer side end of the lower end part of the body portion.

3. The pedal device as claimed in claim 2, wherein the lower end part of the body portion of said reactive force imparting member has a width dimension substantially equal to a width dimension of the base portion.

4. The pedal device as claimed in claim 2, wherein said support member includes a leg portion connected to a lower surface of the mounting portion, and engaging portions in a form of through-holes formed in the mounting portion for engaging the engagement portions formed on the base portion, and the leg portion is connected to the lower surface of the mounting portion inside opposite side edges, in the width direction, of the lower surface of the mounting portion, the engaging portions being disposed between the opposite side edges, in the width direction, of the mounting portion and the leg portion.

5. An electronic musical instrument including the pedal device recited in claim 1.

6. A pedal device comprising:

a pedal having an upper wall, opposed side walls extending downward from opposite side edges of the upper wall that extend in a longitudinal direction of the upper wall, and a space defined under a lower surface of the upper wall between the opposed side walls;

a support portion which supports said pedal in such a manner that said pedal is capable of stroke action in an up-down direction;

a reactive force imparting member provided in the space under the lower surface of said pedal for imparting reactive force to the stroke action of said pedal; and a support member including a pressing portion for pressing said reactive force imparting member, wherein said reactive force imparting member includes a plate-shaped base portion mounted, directly or via another member, on the lower surface of the upper wall, a downwardly-convexed dome-shaped body portion integrally formed on a lower surface of the base portion, and an abutting portion provided on a lower end of the body portion for abutment against the pressing portion, and the pressing portion of said support member has a width dimension smaller than a distance between the opposed side walls of said pedal so that, during the stroke action of said pedal, the pressing portion falls within the space between the opposed side walls.

7. An electronic musical instrument including the pedal device recited in claim 6.

* * * * *